US006488241B1

(12) United States Patent
Kyte et al.

(10) Patent No.: US 6,488,241 B1
(45) Date of Patent: Dec. 3, 2002

(54) CABINET MOUNTED TRASH BAG HOLDER

(76) Inventors: Jason Kyte, 10 Hans Selye, Kirkland, Quebec Province (CA), H9J 3W3; Patrick Mercier, 16 Westfield, Pointe-Clair, Quebec Province (CA), H9R 5S5

( * ) Notice: Subject to any disclaimer, the term of this patent is extended or adjusted under 35 U.S.C. 154(b) by 0 days.

(21) Appl. No.: 09/906,877

(22) Filed: Jul. 17, 2001

(51) Int. Cl.[7] ..... B65B 67/12
(52) U.S. Cl. ..... 248/95; 248/99
(58) Field of Search ..... 248/95, 97, 99, 248/100, 101; 220/440

(56) References Cited

U.S. PATENT DOCUMENTS

| | | | | | |
|---|---|---|---|---|---|
| 570,343 | A | * | 10/1896 | Skreberg | 248/97 |
| 800,087 | A | * | 9/1905 | Downing | 248/101 |
| 1,339,878 | A | * | 12/1922 | Erhardt et al. | 248/101 |
| 2,305,863 | A | * | 12/1942 | Ginter | 248/100 |
| 2,462,973 | A | * | 3/1949 | Kelrick | 248/101 |
| 4,498,652 | A | | 2/1985 | Malik | 248/99 |
| 4,669,689 | A | | 6/1987 | Jones | 248/99 |
| 4,750,695 | A | * | 6/1988 | Greenhouse | 248/99 |
| 4,940,201 | A | * | 7/1990 | Kurth | 248/101 |
| 5,085,385 | A | | 2/1992 | Breitenstein | 248/99 |
| D326,752 | S | * | 6/1992 | Griggs | D34/5 |
| 5,139,219 | A | * | 8/1992 | Navarro | 248/97 |
| 5,154,378 | A | | 10/1992 | Plum | 248/99 |
| 5,163,645 | A | | 11/1992 | Caruso | 248/99 |
| 5,836,553 | A | * | 11/1998 | Bergaila | 248/99 |

* cited by examiner

*Primary Examiner*—Ramon O. Ramirez
*Assistant Examiner*—Kofi Schulterbrandt
(74) *Attorney, Agent, or Firm*—Henderson & Sturm LLP

(57) ABSTRACT

A plastic bag holder (10) for installation on a cabinet door (200) wherein the holder (10) comprises a mounting unit (11) including an inverted generally U-shaped bracket member (20) dimensioned to receive the top (201) of a cabinet door (200) and a support unit (12) formed integrally with the mounting unit (11) and including a generally C-shaped bag support member (40) having a base portion (41) and a pair of mirror image outwardly projecting curved support arms (42) (42') having a generally cruciform cross-sectional configuration over a substantial portion of their respective lengths; wherein the opposed ends of the support arms (42) (42') define a front opening in the support unit (12) that is dimensioned to allow the passage of the upper end (101) of a plastic trash bag (100) to pass through said front opening.

13 Claims, 2 Drawing Sheets

CABINET MOUNTED TRASH BAG HOLDER

CROSS REFERENCE TO RELATED APPLICATIONS

This application is an improvement over our co-pending U.S. patent application Ser. No. 09/567,349 filed on May 9, 2000, and entitled "Plastic Bag Suspension Device."

BACKGROUND OF THE INVENTION

1. Field of the Invention

The present invention relates to the field of cabinet mounted trash bag holders in general and in particular to a reinforced dual armed trash bag holder that allows the top of the trash bag to be withdrawn through the open front of the holder.

2. Description of Related Art

As can be seen by reference to the following U.S. Pat. Nos. 4,498,652, 4,669,689; 5,085,385; 5,154,378; and, 5,163,645, the prior art is replete with myriad and diverse cabinet door attached trash bag holding devices.

While all of the aforementioned prior art constructions are more than adequate for the basic purpose and function for which they have been specifically designed, they are uniformly deficient with respect to their failure to provide a simple, efficient, and practical cabinet mounted trash bag holder device that does not require specialized hardware to mount the device on the cabinet door and employs a reinforced dual arm arrangement that permits the top of the trash bag to be withdrawn through the front of the device.

As most people are all too well aware, the usefulness of a cabinet mounted trash bag holder cannot be denied; however, they are normally poorly designed and have a limited useful life due to their inherently flimsy construction.

As a consequence of the foregoing situation, there has existed a long-standing need among the general populace for a new and improved long lasting, sturdily constructed cabinet mounted plastic trash bag holder which is quick to install and easy to use both with respect to installing and removing a bag relative to the holder device; and, the provision of such a construction is the stated objective of the present invention.

BRIEF SUMMARY OF THE INVENTION

Briefly stated, the cabinet mounted trash bag holder device that forms the basis of the present invention comprises in general a mounting unit and a support unit formed integrally with the mounting unit.

As will be explained in greater detail further on in the specification, the mounting unit comprises a generally inverted U-shaped bracket member which is adapted to receive and frictionally engage the upper portion of a cabinet door wherein the bracket member is provided with a plurality of stiffening elements to provide both rigidity and support to the bracket member.

In addition, the support unit comprises a pair of mirror image support arm members having a generally cruciform cross-sectional configuration wherein the support arm members have an inherent resiliency that allows the arms to be inwardly deformed to accept the folded over top of a plastic bag which is frictionally engaged by the support arms in their relaxed position; and, wherein the arms define a front opening that allows the upper portion of the plastic bag to be inserted and withdrawn through the front opening.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
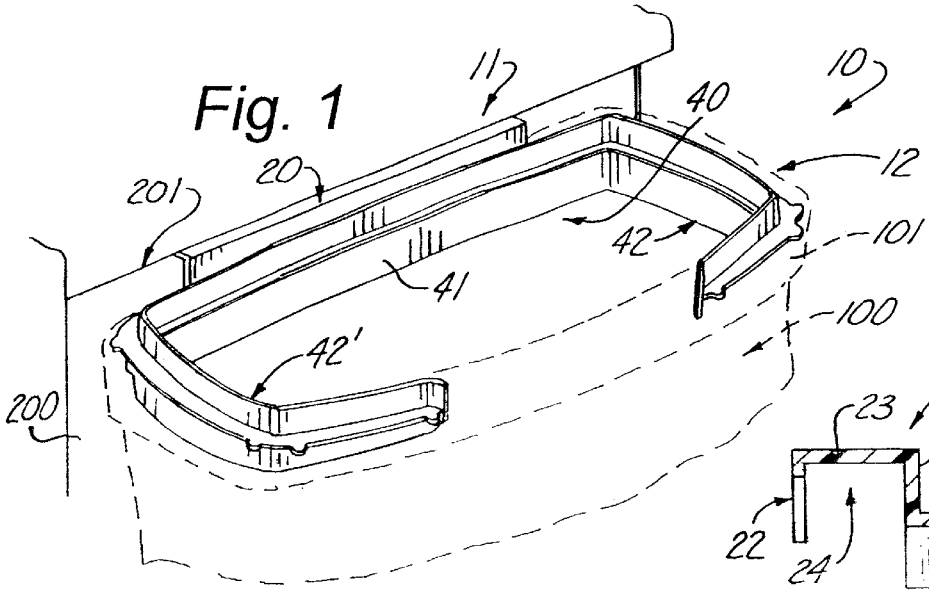
FIG. 1 is a perspective view of the bag holding device mounted on the front of a cabinet door.

As can be seen by reference to the drawings, and in particular to FIG. 1, the cabinet mounted bag holder device that forms the basis of the present invention is designated generally by the reference number 10. The device 10 comprises in general a mounting unit 11 and an integrally formed support unit 12. These units will now be described in seriatim fashion.

Figure 3:
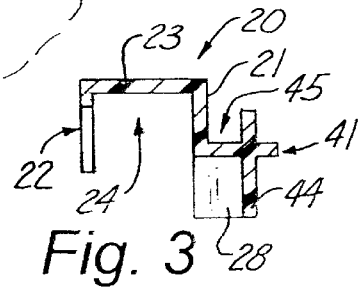
FIG. 3 is a cross-sectional view taken through line 3—3 of FIG. 2.
Figure 2:
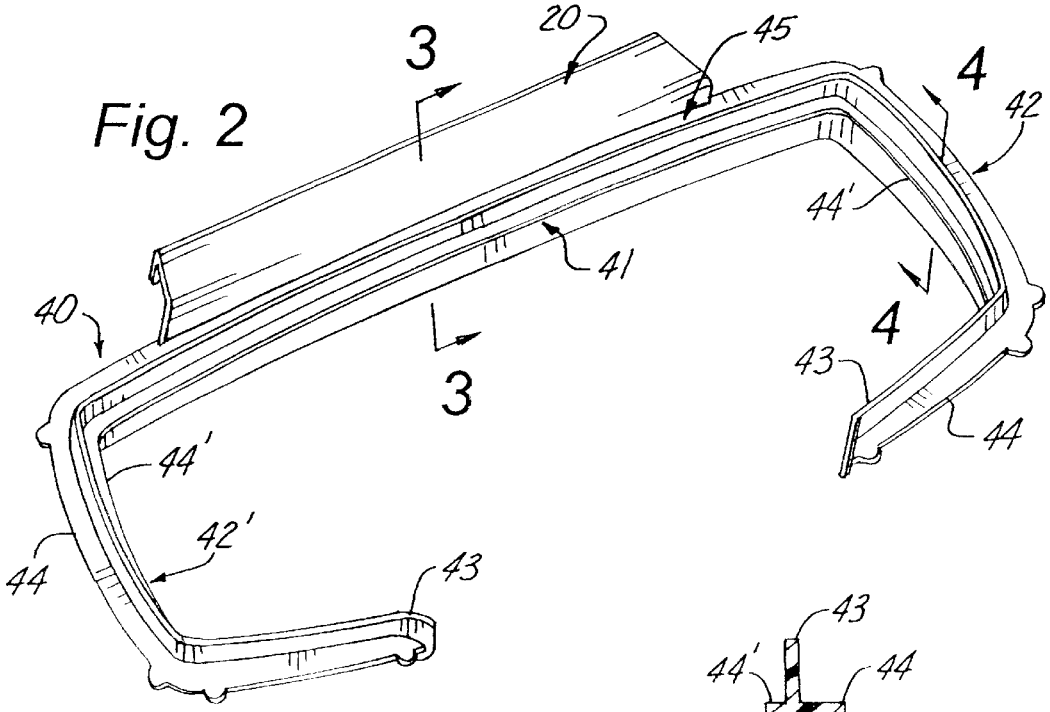
FIG. 2 is an isolated front perspective view of the bag holding device.
Figure 5:
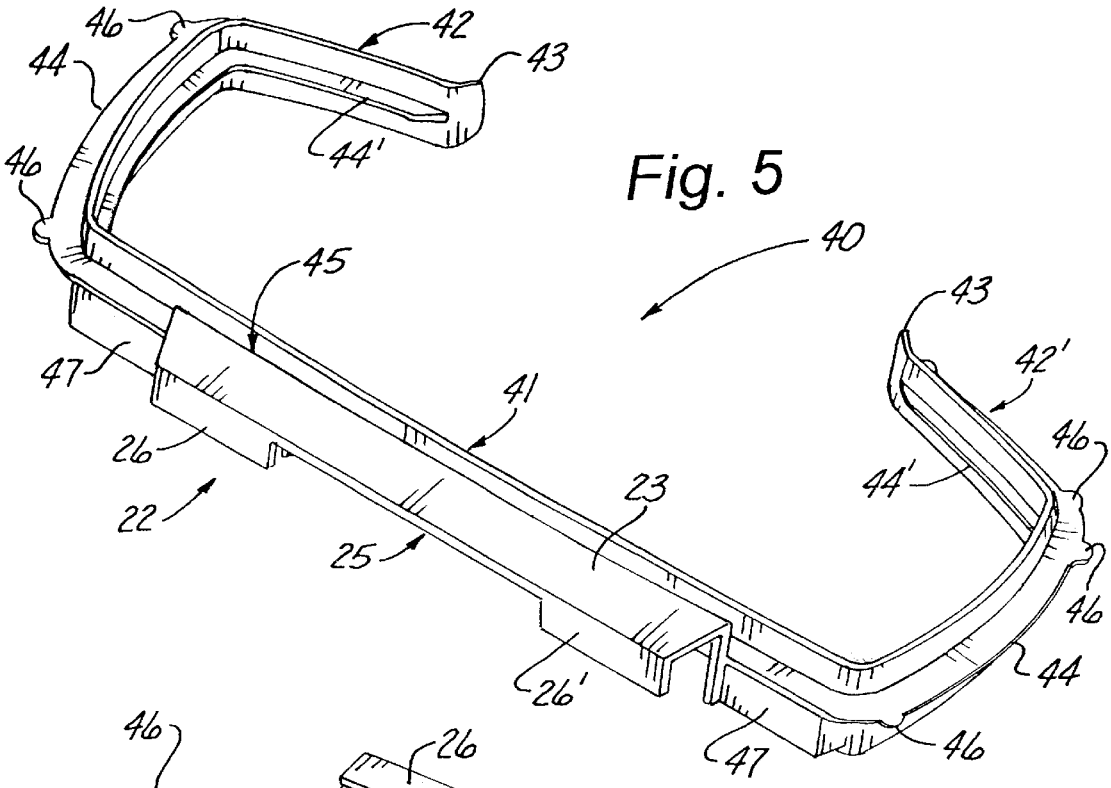
FIG. 5 is an isolated rear perspective view of the bag holder device.
Figure 6:
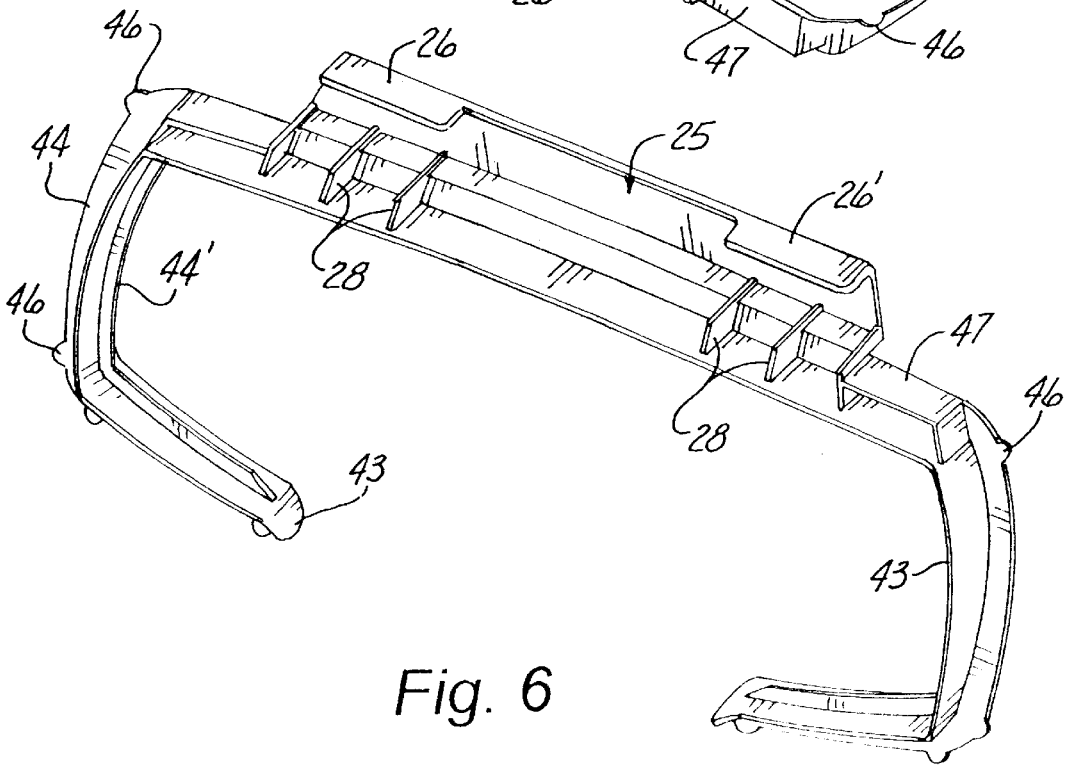
FIG. 6 is an isolated bottom perspective view of the bag holder device.

As can best be seen by reference to FIGS. 3, 5, and 6, the mounting unit 11 comprises an elongated generally inverted U-shaped bracket member 20 having an elongated generally vertical truncated front face 21 and an elongated generally vertical rectangular rear face 22 which are connected to one another by a generally horizontal top surface 23; wherein, the bottom opening 24 defined by the front 21 and rear 22 faces and top surface 23 is dimensioned to receive the top of a cabinet door 200 in a well recognized manner.

In addition, as shown in FIGS. 5 and 6, the bottom of the rear face 22 is provided with an elongated recess 25 that defines a pair of foot pads 26 26' that are adapted to engage the rear surface of the top of a cabinet door 200.

Turning now to FIGS. 2 through 6, it can be seen that the support unit 12 comprises a generally C-shaped bag support member 40 formed integrally with the mounting unit 11 from a generally rigid yet flexible material such as plastic or the like. The support member 40 includes a base portion 41 provided with two mirror- image, outwardly projecting curved support arms 42 42'.

Figure 4:
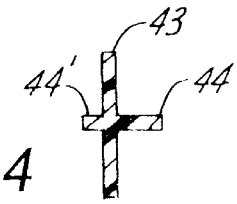
FIG. 4 is a cross-sectional view taken through line 4—4 of FIG. 2.

Furthermore, as can be seen by reference particularly to FIGS. 3 and 4, both the base portion 41 and the support arms 42 42' have generally cruciform cross-sectional configurations; wherein the vertical stem 43 of the cruciform configuration provides support for the plastic bag 100 and the outboard and inboard cross-arms 44 44' provide a stiffening effect for the support arms 42 42' which limits the amount of flexibility that is imparted to the support arms 42 42' as well as providing an overall rigidity and strength to the bag holder device 10.

As can also be appreciated by reference to FIGS. 1, 3 and 5, the juncture between the outer cross arm 44 of the support member 40 with both the front face 21 of the mounting bracket member 20 and the upper portion of the vertical stem 43 defines a channel 45 that is intended to receive the rear portion of the top 101 of a plastic bag 100.

In addition, the curved outer end of the support arms 42 42' are flared outwardly and only contain the vertical stem 43 of the cruciform cross-sectional configuration and the external periphery of the outer cross-arms 44 are provided with a plurality of outwardly extending projections 46 for reasons that will be explained presently.

Turning now to FIGS. 3 and 6, it can be seen that the mounting bracket 20 is provided with a plurality of downwardly and outwardly extending vertical stiffening ribs 28 that are formed integrally with the underside of the outboard cross-arm 44 and the lower interior portion of the vertical stem 43 again for the purpose of imparting structural rigidity to the overall bag holder device 10.

Furthermore, as can be seen in particular by reference to FIG. 6, a pair of generally L-shaped stiffening flanges 47 project outwardly from the outer stiffening ribs 46 wherein the leg portion of the stiffening flanges extend downwardly from the outer edge of the outboard cross-arm and the foot portion of the stiffening flange 47 is perpendicularly disposed relative to the bottom of the outboard cross-arm 44 and the lower portion of the vertical stem 43.

In use, an individual would unfold a plastic bag and grasping the top 101 of the bag 100, pass the intermediate portion of the unfolded bag 100 through the opening 50 between the opposed end of the curved support arms 42 42'. Then the user would fold back the top 101 of the plastic bag and compress the support arms 42 42' in a well recognized manner to allow the folded over top of the bag to be draped over the support arms 42 42' and be received in the channel 45 between the base portion 41 of the support member 40 and the front face 21 of the mounting bracelet member 20.

Then once the trash bag has been filled, the user would disengage the bag 100 from the support member 40 by twisting or tying closed the upper end of the bag 100 and withdrawing the upper end of the bag through the opening 50 between the outer ends of the support arms 42 42'.

It should further be noted that while the bag 100 is installed on the support arms 42 42', the inherent resiliency of the support arms 42 42' as well as the outwardly extending projections 46 on each of the support arms 42 42' maintains the top 101 of the bag 100 in place in a well recognized manner.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A cabinet mounted plastic bag holder for installation over the top of a cabinet door wherein the bag holder comprises a mounting unit including a generally inverted U-shaped bracket member having a bottom opening dimensioned to receive the top of a cabinet door; and, a support unit formed integrally with the mounting unit and including a generally C-shaped bag support member having a base portion fixedly connected to the bracket member and including two outwardly projecting curved support arms whose opposed ends define a front opening; wherein the base portion and each of said support arms include a vertical stem having a top portion and a bottom portion wherein the top portion provides a bearing surface for the folded over top of a plastic bag; and, wherein the stems of the base portion and each support arm has an exterior surface provided with an outboard cross-arm wherein the outboard cross-arm on the base portion is connected directly to said bracket member.

2. The bag holder as in claim 1; wherein, the outboard cross-arm is provided with a plurality of projections which are adapted to frictionally engage the folded over top of a plastic bag.

3. The bag holder as in claim 1; wherein, the vertical stem has an exterior surface provided with an inboard cross-arm.

4. The bag holder as in claim 1; wherein, at least the support arms have a generally cruciform cross-sectional configuration over at least a substantial portion of this respective lengths.

5. The bag holder as in claim 4, wherein, the outer ends of the support arms are curved outwardly.

6. The bag holder as in claim 5; wherein, the outer ends of the support arms have a slim vertical cross-sectional profile.

7. The bag holder as in claim 1; wherein, the base portion and each of the support arms have a generally cruciform cross-sectional configuration over at least a portion of their length.

8. A cabinet mounted plastic bag holder for installation over the top of a cabinet door wherein the bag holder comprises a mounting unit including a generally inverted U-shaped bracket member having a bottom opening dimensioned to receive the top of a cabinet door; and, a support unit formed integrally with the mounting unit and including a generally C-shaped bag support member having a base portion fixedly connected to the bracket member and including two outwardly projecting curved support arms whose opposed ends define a front opening; wherein, the bracket member includes a front face and a rear face connected to one another by a top surface wherein the front and rear faces and the top surface define a bottom opening that is dimensioned to receive the top of a cabinet door; and, wherein, the front face is truncated relative to the rear face and operatively associated with said support unit.

9. The bag holder as in claim 8; wherein, the rear face has a bottom provided with an elongated recess that defines a pair of foot pads that are adapted to frictionally engage the rear of the upper portion of a cabinet door.

10. The bag holder as in claim 9, wherein, the mounting bracket member is, further provided with a plurality of downwardly and outwardly extending stiffening ribs.

11. The bag holder as in claim 10; wherein, said stiffening ribs are disposed opposite the pair of foot pads on the rear face of the bracket member.

12. The bag holder as in claim 11, wherein, said stiffening ribs are operatively associated with a portion of the support unit.

13. The bag holder as in claim 12; wherein, the operative connection between the bracket member and the support unit further includes a pair of L-shaped stiffening flanges which project outwardly from the outermost stiffening ribs.

* * * * *